US009931765B1

(12) United States Patent
Okeefe

(10) Patent No.: US 9,931,765 B1
(45) Date of Patent: Apr. 3, 2018

(54) MIXING MACHINE

(71) Applicant: James Okeefe, Ashaway, RI (US)

(72) Inventor: James Okeefe, Ashaway, RI (US)

( * ) Notice: Subject to any disclaimer, the term of this patent is extended or adjusted under 35 U.S.C. 154(b) by 168 days.

(21) Appl. No.: 14/948,566

(22) Filed: Nov. 23, 2015

(51) Int. Cl.
*B28C 5/18* (2006.01)
*B28C 5/08* (2006.01)

(52) U.S. Cl.
CPC ..... *B28C 5/1812* (2013.01); *B28C 5/0831* (2013.01)

(58) Field of Classification Search
CPC ..... B28C 5/1806
USPC ..... 366/56, 57, 213, 225, 228
See application file for complete search history.

(56) References Cited

U.S. PATENT DOCUMENTS 1,074,388 A * 9/1913 Stedman ..... B01F 9/08 366/56
1,349,285 A * 8/1920 Lynch ..... B01F 15/00564 298/10
2,510,858 A 6/1950 Black
4,078,263 A 3/1978 Campbell
D256,800 S 9/1980 Deen
2,597,291 A1 8/2006 Broome
7,229,204 B2 6/2007 Haskell
7,229,656 B2 6/2007 Paumen
8,360,628 B2 1/2013 Cheung

FOREIGN PATENT DOCUMENTS

DE 20022682 U1 4/2002

* cited by examiner

*Primary Examiner* — David Sorkin

(57) ABSTRACT

The mixing machine is a motorized cement mixer that designed to mix cement in batches of less than 1 cubic foot. The mixing machine comprises a mixing bucket, a paddle insert, a motor, a drive system, a housing, and a control system. The mixing bucket is used to contain the cement or concrete mixture. The paddle insert is an insert designed to go into the mixing bucket. The paddle insert further comprises a plurality of paddles that are used to agitate the concrete mixture to insure efficient mixing. The motor and drive system are used to rotate the mixing bucket to efficiently mix the concrete mixture, and to prevent the concrete mixture from setting in the mixing bucket. The mixing machine comprises a mixing bucket, a paddle insert, a motor, a drive system, a housing, and a control system.

2 Claims, 5 Drawing Sheets

MIXING MACHINE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of mortar mixers, more specifically, a motorized concrete mixer.

SUMMARY OF INVENTION

The mixing machine is a motorized cement mixer that designed to mix cement in batches of less than 1 cubic foot. The mixing machine comprises a mixing bucket, a paddle insert, a motor, a drive system, a housing, and a control system. The mixing bucket is used to contain the cement or concrete mixture. The paddle insert is an insert designed to go into the mixing bucket. The paddle insert further comprises a plurality of paddles that are used to agitate the concrete mixture to insure efficient mixing. The motor and drive system are used to rotate the mixing bucket to: 1) efficiently mix the concrete mixture; and 2) to prevent the concrete mixture from setting in the mixing bucket.

These together with additional objects, features and advantages of the mixing machine will be readily apparent to those of ordinary skill in the art upon reading the following detailed description of the presently preferred, but nonetheless illustrative, embodiments when taken in conjunction with the accompanying drawings.

In this respect, before explaining the current embodiments of the mixing machine in detail, it is to be understood that the mixing machine is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the mixing machine.

It is therefore important that the claims be regarded as including such equivalent construction insofar as they do not depart from the spirit and scope of the mixing machine. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
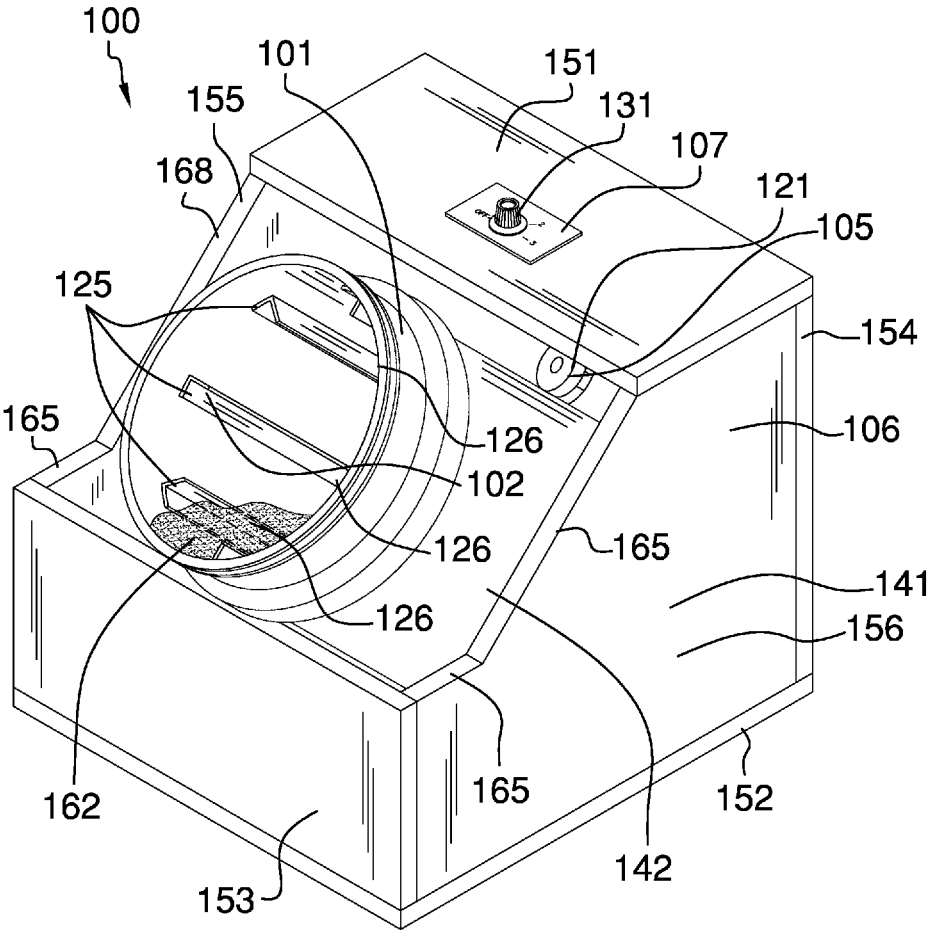
FIG. 1 is a perspective view of an embodiment of the disclosure.
Figure 2:
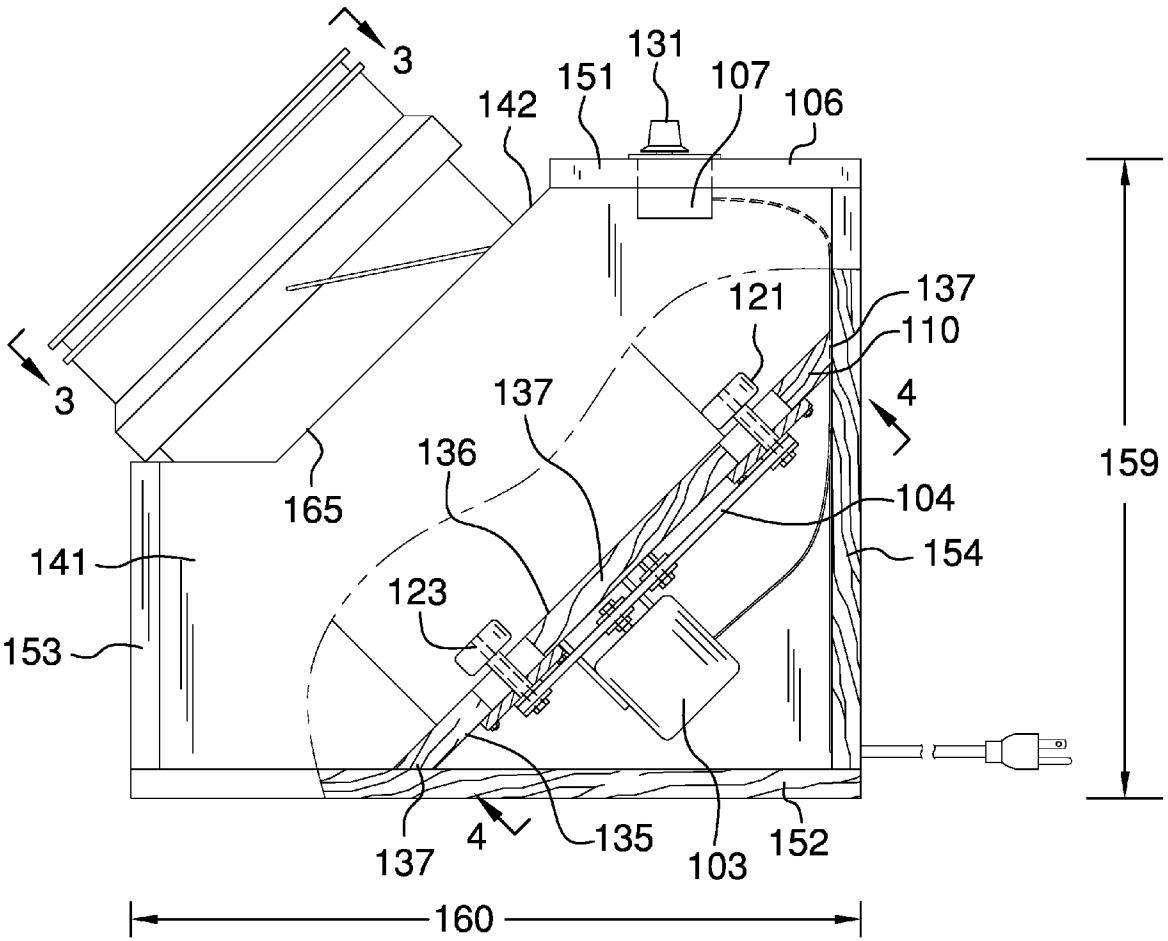
FIG. 2 is a side view of an embodiment of the disclosure.
Figure 3:
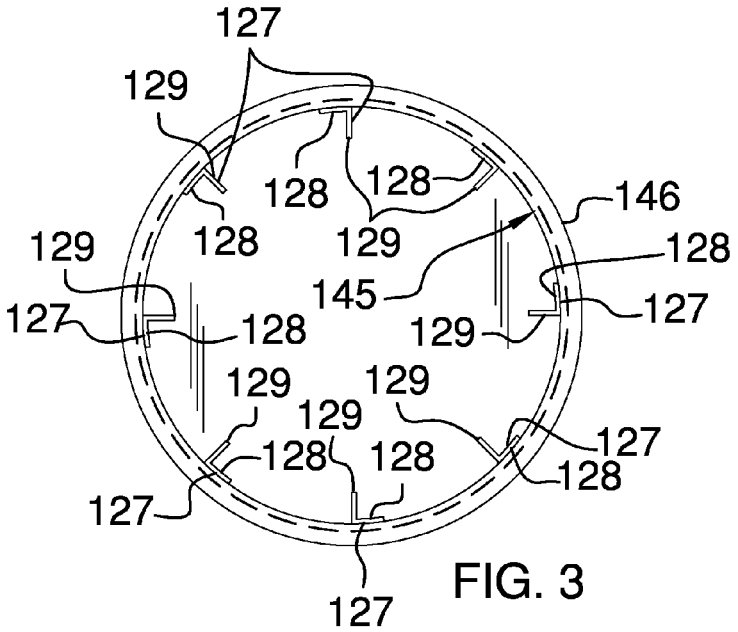
FIG. 3 is a detail view of an embodiment of the disclosure.
Figure 4:
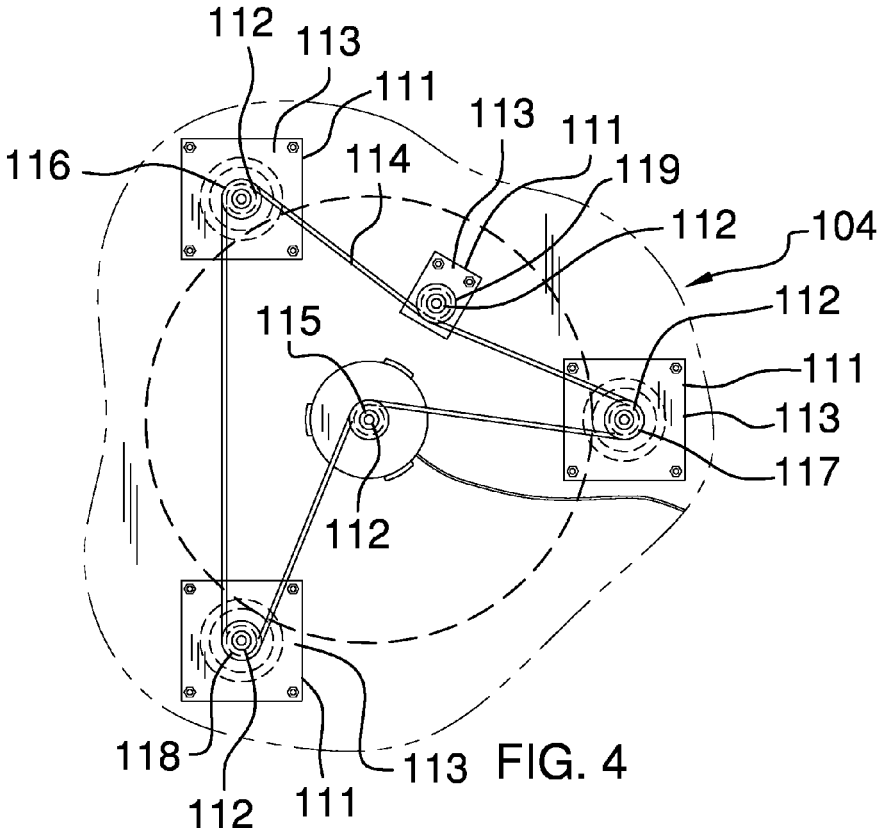
FIG. 4 is a cross-sectional view of an embodiment of the disclosure.
Figure 5:
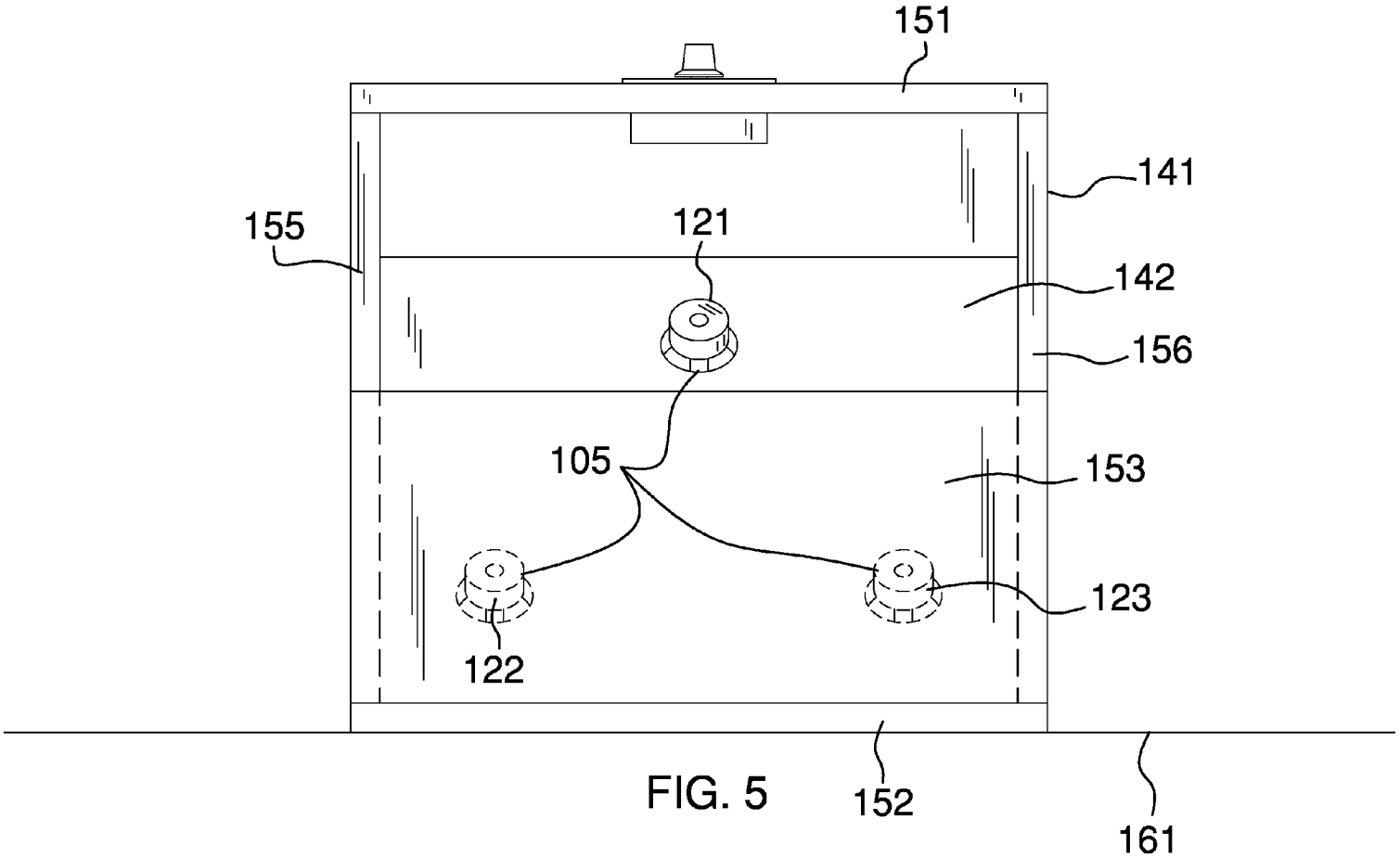
FIG. 5 is a front view of an embodiment of the disclosure.
Figure 6:
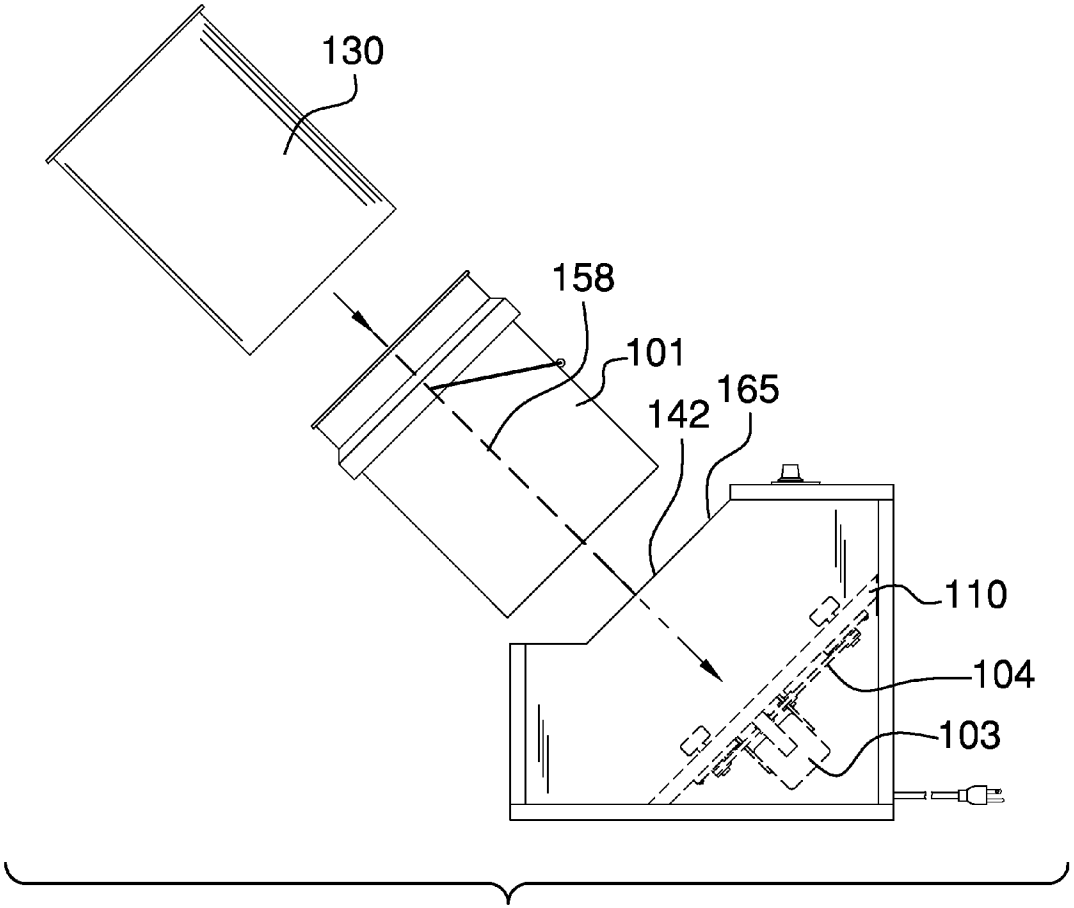
FIG. 6 is an exploded view of an embodiment of the disclosure.

Detailed reference will now be made to a first potential embodiment of the disclosure, which is illustrated in FIGS. 1 through 6. The mixing machine 100 (hereinafter invention) comprises a mixing bucket 101, a paddle insert 102, a motor 103, a drive system 104, a housing 106, and a control system 107.

The mixing bucket 101 is a commercially available 5-gallon bucket that is used to contain the cement. The paddle insert 102 is a plurality of paddles 125 that are attached to the interior side 145 of the mixing bucket 101. Each individual paddle 126 selected from the plurality of paddles 125 is formed in an L shape 127 that runs along the length 157 of the mixing bucket 101. The L shape 127 is further defined with a first leg 128 and a second leg 129. The first leg 128 of the L shape 127 is attached to the interior side 145 of the mixing bucket 101. The second leg 129 of the L shape 127 projects perpendicularly away from the interior side 145 of the mixing bucket 101 towards the center axis 158 of the cylinder of the mixing bucket 101.

As described elsewhere in this disclosure, the motor 103 and the drive system 104 will rotate the mixing bucket 101 around the center axis 158. The purpose of the plurality of paddles 125 is to pull some of the concrete 162 up along the side of the mixing bucket 101. Each individual paddle 126 will carry the a portion of the concrete 162 from lower section of the mixing bucket 101 up the side of the mixing bucket 101 until the individual paddle 126 reaches an angle from which the concrete 162 will pour off of each individual paddle 126 back into lower section of the bucket thereby mixing the concrete 162.

In a second potential embodiment of the disclosure, the plurality of paddles 125 is mounted in a paddle frame 130. The paddle frame 130 is a cylindrical tube that has mounted within it the plurality of paddles 125 in the same manner as was described previously. The cylindrical tube is sized to fit within the mixing bucket 101. The advantages of using the paddle frame 130 are: 1) the paddle frame 130 can be used with multiple mixing buckets 101, allowing a previously made first batch of concrete 162 to be used while a second batch of concrete 162 is being made using the paddle frame 130 and a second mixing bucket 101; and, 2) the use of the paddle frame 130 simplifies cleaning of the invention 100.

The drive system 104 comprises a drive board 110, a plurality of pulleys 111, a belt 114, a first roller 121, a second roller 122, and a third roller 123. The purpose of the drive system 104 is to rotate the mixing bucket 101 in order to mix the concrete 162. The drive system 104 does this by providing a location where the mixing bucket 101 is placed 101 such that the exterior side 146 of the mixing bucket 101 is in contact with a plurality of rollers 105. The drive system 104 rotates the plurality of rollers 105 which in turn rotates the mixing bucket 101. In the first potential embodiment of the disclosure, the plurality of rollers 105 further comprises a first roller 121, a second roller 122, and a third roller 123.

The drive board 110 is a structure upon which the drive system 104 is mounted. The drive board 110 is a rectangular board that is further defined with a first side 135, a second side 136 and a plurality of edges 137. Each of the plurality of edges 137 is formed with a 45-degree bevel. The 45-degree bevel is positioned such that the surface area of the second side 136 is greater than the surface area of the first side 135.

Each of the plurality of pulleys 111 further comprises an individual pulley 112 and a mounting plate 113. The mounting plate 113 is used to attach the individual pulley 112 to the first side 135 of the drive board 110. The plurality of pulleys 111 further comprises a motor pulley 115, a first roller pulley 116, a second roller pulley 117, a third roller pulley 118, and an idler pulley 119. The first roller pulley 116 is mounted using the mounting plate 113 to the first side 135 of the drive board 110. A hole is formed in the drive board 110 where the first roller pulley 116 is positioned to allow a shaft from the first roller 121 to be placed through the drive board 110 from the second side 136 of the drive board 110 to be attached to the first roller pulley 116. This allows the rotation of the first roller pulley 116 to rotate the first roller 121. The second roller pulley 117 is mounted using the mounting plate 113 to the first side 135 of the drive board 110.

A hole is formed in the drive board 110 where the second roller pulley 117 is positioned to allow a shaft from the second roller 122 to be placed through the drive board 110 from the second side 136 of the drive board 110 to be attached to second roller pulley 117. This allows the rotation of second roller pulley 117 to rotate the second roller 122. The third roller pulley 118 is mounted using the mounting plate 113 on the first side 135 of the drive board 110. A hole is formed in the drive board 110 where the third roller pulley 118 is positioned to allow a shaft from the third roller 123 to be placed through the drive board 110 from the second side 136 of the drive board 110 to be attached to the third roller pulley 118. This allows the rotation of the third roller pulley 118 to rotate the third roller 123. An idler pulley 119 is mounted on the first side 135 of the drive board 110. The purpose of the idler pulley 119 is to guide the belt 114 as the belt 114 moves through the plurality of pulleys 111. The idler pulley 119 is also used to allow for adjustments in the tension of the belt 114.

The motor 103 is an electric motor that is mounted on the first side 135 of the drive board 110. The motor 103 is used to rotate the motor pulley 115, which is used to power the drive system 104. As most clearly shown in FIG. 4, the belt 114 is used to connect to and transmit the rotation of the motor pulley 115 to the first roller pulley 116, second roller pulley 117, third roller pulley 118 and idler pulley 119 which in turn rotates the first roller 121, the second roller 122, and the third roller 123 in the same direction.

The mixing bucket 101 and the drive board 110 containing the drive system 104, plurality of rollers 105, and the motor 103 is contained in the housing 106. The housing 106 is a box 141 that is further defined by a top 151 side, a bottom 152 side, front 153 side, a rear 154 side, a left 155 side, and a right 156 side. The bottom 152 side of the box 141 is placed on the ground 161. The top 151 side of the box 141 is the side distal from the bottom 152 side of the box 141. The front 153 side of the box 141 is identified as the side that is perpendicular to the top 151 side and the bottom 152 side that has less height 159 than the remaining sides of the box 141. When viewed from the top 151 side, the remaining sides of the box 141, going clockwise from the front 153 side, are called the left 155 side, the rear 154 side, and the right 156 side.

The box 141 differs from the shape of a rectangular block because a bucket aperture 142 is formed in the box 141. The bucket aperture 142 is formed by reducing the height 159 of the front 153 side and reducing the width 160 of the top 151 side from the heights and widths that would have theoretically made the box 141 a rectangular block. To complete the bucket aperture 142, a multi-angle segment 165 is removed from the left 155 side and the right 156 side to smoothly connect the top 151 side and the front 153 side.

The control system 107 comprises a readily and commercially available spring wound auto off switch 131 with a delay time of up to six hours. The control system 107 is mounted so that it is accessible on the top 151 side of the housing 106.

To assemble the invention 100, the bottom 152 side, front 153 side, rear 154 side, left 155 side, and right side 156 of the box 141 are first assembled. The drive system 104, motor 103, and the plurality of rollers 105 are assembled and mounted on the drive board 110. The plurality of rollers 105 are positioned on the second side 136 of the drive board 110 such that the mixing bucket 101 can fit within the circumference formed by the plurality of rollers 105 and such that the mixing bucket 101 is in contact with each roller selected from the plurality of rollers 105. The drive board 110 is inserted into the housing 106 such that: 1) the first side 135 of the drive board 110 faces the rear 154 side and the bottom 152 side of the housing 106; 2) one edge selected from the plurality of edges 137 is in contact with the rear 154 side of the housing 106; 3) one edge selected from the plurality of edges 137 is in contact with the bottom 152 side of the housing 106; 4) one edge selected from the plurality of edges 137 is in contact with the left 155 side of the housing 106; 5) one edge selected from the plurality of edges 137 is in contact with the right 156 side of the housing 106. The control system 107 is mounted in the top 151 side of the housing 106 and the top 151 side of the housing 106 is installed to complete the invention 100.

To use the invention 100, the mixing bucket 101 is inserted through the bucket aperture 142 such that it rests on the second side 136 of the drive board 110 and is in contact with the plurality of rollers 105. If a paddle frame 130 is used as a paddle insert 102, then the paddle frame 130 is inserted into the mixing bucket 101. The invention 100 is plugged in and turned on and the concrete 162 is mixed as normal.

The following definition was used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A mixing machine comprising:

a mixing bucket, a paddle insert, a motor, a drive system, a housing, and a control system;

wherein the mixing machine is adapted for use with cement;

wherein the mixing bucket rotates;

wherein the mixing machine further comprises multiple integral paddles;

wherein the mixing bucket is a five-gallon bucket;

wherein the paddle insert is a plurality of paddles that are attached to the interior side of the mixing bucket;

wherein each individual paddle selected from the plurality of paddles is formed in an L shape;

wherein each individual paddle selected from the plurality of paddles runs along the length of the mixing bucket;

wherein the L shape is further defined with a first leg and a second leg;

wherein the first leg of the L shape is attached to the interior side of the mixing bucket;

wherein the second leg of the L shape projects perpendicularly away from the interior side of the mixing bucket towards the center axis of a cylinder of the mixing bucket;

wherein the motor is an electric motor;

wherein the drive system comprises a drive board, a plurality of pulleys, a belt, a first roller, a second roller, and a third roller;

wherein the drive board further comprises a first side and a second side;

wherein the first roller further comprises a first roller shaft;

wherein the second roller further comprises a second roller shaft;

wherein the third roller further comprises a third roller shaft;

wherein the motor is mounted on the first side of the drive board;

wherein a paddle frame is a cylindrical tube that is sized to fit within the mixing bucket;

wherein each of the plurality of paddles are mounted on the interior side of the cylindrical tube;

wherein the housing contains the mixing bucket, the drive system and the motor;

wherein the control system comprises a spring wound auto off switch.

2. The mixing machine according to claim 1 wherein the plurality of pulleys further comprises a first roller pulley, a second roller pulley, a third roller pulley, and an idler pulley;

wherein the first roller pulley is mounted to the first side of the drive board;

wherein the first roller pulley is positioned to allow the first roller shaft to be attached to the first roller pulley;

wherein the second roller pulley is mounted to the first side of the drive board;

wherein the second roller pulley is positioned to allow the second roller shaft to be attached to second roller pulley;

wherein the third roller pulley is mounted to the first side of the drive board;

wherein the third roller pulley is positioned to allow the third roller shaft to be attached to the third roller pulley;

wherein the idler pulley is mounted on the first side of the drive board.

* * * * *